US012655598B2

(12) United States Patent
Li et al.

(10) Patent No.: US 12,655,598 B2
(45) Date of Patent: Jun. 16, 2026

(54) VIBRATORY GROUTING ROD WITH DRILLING AND VIBRATING FUNCTIONS AND METHOD FOR USING THE SAME

(71) Applicants: Zhengzhou University, Zhengzhou (CN); BeSTDR Infrastructure Hospital(Pingyu), Zhumadian (CN)

(72) Inventors: Xiaolong Li, Zhengzhou City (CN); Yanhui Zhong, Zhengzhou City (CN); Bei Zhang, Zhengzhou City (CN); Lei Feng, Zhumadian (CN); Xinjian Fan, Zhengzhou City (CN); Yongli Chen, Zhumadian (CN)

( * ) Notice: Subject to any disclaimer, the term of this patent is extended or adjusted under 35 U.S.C. 154(b) by 0 days.

(21) Appl. No.: 19/185,136

(22) Filed: Apr. 21, 2025

(65) Prior Publication Data

US 2025/0250761 A1 Aug. 7, 2025

(30) Foreign Application Priority Data

Apr. 23, 2024 (CN) ..... 202410490115.7

(51) Int. Cl.

| | |
|---|---|
| ***E02D 15/04*** | (2006.01) |
| ***E02D 3/12*** | (2006.01) |
| ***E21B 7/24*** | (2006.01) |
| ***E21B 17/20*** | (2006.01) |
| ***E21B 21/00*** | (2006.01) |
| ***E21B 27/00*** | (2006.01) |
| ***E21B 28/00*** | (2006.01) |
| ***E21B 33/138*** | (2006.01) |
| ***E21B 43/00*** | (2006.01) |

(52) U.S. Cl.

CPC ..... *E02D 15/04* (2013.01); *E02D 3/12* (2013.01); *E21B 7/24* (2013.01); *E21B 17/20* (2013.01); *E21B 21/00* (2013.01); *E21B 27/00* (2013.01); *E21B 28/00* (2013.01); *E21B 33/138* (2013.01); *E21B 43/003* (2013.01)

(58) Field of Classification Search

None

See application file for complete search history.

(56) References Cited

U.S. PATENT DOCUMENTS

2011/0103898 A1* 5/2011 Wang ..... E02D 3/12 405/266

2014/0314496 A1* 10/2014 Wang ..... E02D 5/46 405/233

(Continued)

*Primary Examiner* — Blake Michener

(57) ABSTRACT

A vibratory grouting rod with drilling and vibrating functions includes: a drill bit, a vibration part, a flexible shock absorption device, a slotted connection part, a connection tail part, and a rigid-flexible conversion device; wherein the vibration part, the flexible shock absorption device, the slotted connection part and the connection tail part are sequentially jointed to form a grouting rod body, and the grouting rod body has a holding cavity; the drill bit is provided at a front end of the vibration part; and the rigid-flexible conversion device is movably sleeved on the flexible shock absorption device, which is configured to move up and down in a bar-shaped slot of the slotted connection part. The rigid-flexible conversion device can be pushed down to a rigid mode for drilling, and pulled up to a flexible mode for grouting with vibration concentrated around the vibration part.

8 Claims, 6 Drawing Sheets

(56) References Cited

U.S. PATENT DOCUMENTS

| | | | | |
|---|---|---|---|---|
| 2014/0314497 | A1* | 10/2014 | Wang | E02D 5/34 405/240 |
| 2014/0314498 | A1* | 10/2014 | Wang | E02D 19/12 405/266 |
| 2017/0247971 | A1* | 8/2017 | Rivas Diaz | E21B 23/00 |
| 2023/0313484 | A1* | 10/2023 | Wang | E02D 3/12 405/258.1 |

* cited by examiner

VIBRATORY GROUTING ROD WITH DRILLING AND VIBRATING FUNCTIONS AND METHOD FOR USING THE SAME

CROSS REFERENCE OF RELATED APPLICATION

The present invention claims priority under 35 U.S.C. 119 (a-d) to CN 202410490115.7, filed A pr. 23, 2024.

BACKGROUND OF THE PRESENT INVENTION

Field of Invention

The present invention relates to a technical field of vibratory grouting in saturated sandy soil, and more particularly to a vibratory grouting rod with drilling and vibrating functions and a method for using the same.

Description of Related Arts

Saturated sand layer is a common weak and deficient stratum, and usually countered in underground comprehensive pipeline corridors, subways, tunnels and other projects. Due to the loose structure, poor self-stabilizing ability, sudden deformation and potential accidents, reinforcement and seepage control of such layer have always been a hot spot in engineering research. Under vibration, the pore water pressure in the soil body of the saturated sand layer rises suddenly, so that the stress between the soil particles is reduced to zero, leading to a nearly liquid state of the soil body. Although the development of grouting methods has been more mature in many aspects, the grouting effect for the sandy soil stratum has not yet been as good as it should be, and it is often difficult for the slurry to be injected. Conventionally, grouting rod commonly used in the grouting construction does not have a vibration function itself or the vibration effect is poor, not to mention the rigid-flexible conversion function. Chinese patent application 201720205527.7 disclosed a self-feeding anchor rod, which has a vibration function, but does not have the rigid-flexible conversion function.

SUMMARY OF THE PRESENT INVENTION

In order to solve the technical problems in the prior art, an object of the present invention is to provide a vibratory grouting rod with drilling and vibrating functions and a method for using the same.

Accordingly, in order to accomplish the above object, the present invention provides a vibratory grouting rod with drilling and vibrating functions, comprising: a drill bit, a vibration part, a flexible shock absorption device, a slotted connection part, a connection tail part, and a rigid-flexible conversion device; wherein the vibration part, the flexible shock absorption device, the slotted connection part and the connection tail part are sequentially jointed to form a grouting rod body, and the grouting rod body has a holding cavity; the drill bit is provided at a front end of the vibration part; and the rigid-flexible conversion device is movably sleeved on the flexible shock absorption device, which is configured to move up and down in a bar-shaped slot of the slotted connection part to accomplish rigid-flexible conversion. During drilling, the rigid-flexible conversion device is pushed down to set to a rigid mode, making the flexible shock absorption device unstressed and protected by the rigid-flexible conversion device, thereby preventing the flexible shock absorption device from being damaged. At this time, the drill bit moves downward to a designated position. During grouting, the rigid-flexible conversion device is pulled up to set to a flexible mode, so that the flexible shock absorption device is exposed. Under the flexible mode, vibration is concentrated in the sandy soil around the vibration part. When the sandy soil is disturbed, the effective stress between soil particles is reduced, which is conducive to the diffusion of slurry, and that is the vibratory grouting. During vibratory grouting, the flexible shock absorption device plays a damping role, to prevent vibration from upward transmission to the slotted connection part and the connection tail part, ensuring that the vibration source is in the sand layer.

Preferably, the rigid-flexible conversion device comprises a first conversion part, a second conversion part and a push-pull rod; wherein the second conversion part is connected to the first conversion part through a plurality of fixing posts;

a first recess is provided on one side, which is close to the vibration part, of the first conversion part; and a first protrusion is provided on one side, which is close to the vibration part, of the flexible shock absorption device, matching the first recess; when the push-pull rod pushes the second conversion part to a point where the first protrusion is inserted into the first recess, then the rigid mode is set, wherein the first conversion part is engaged with the first connection part of the flexible shock absorption device, so as to drill under the rigid mode;

a second recess is provided on the other side, which is close to the slotted connection part, of the first conversion part; and a second protrusion is provided on the other side, which is close to the slotted connection part, of the flexible shock absorption device, matching the second recess; when the push-pull rod pulls the second conversion part to a point where the second protrusion is inserted into the second recess, then the flexible mode is set, wherein the first conversion part is engaged with the second connection part of the flexible shock absorption device; the flexible shock absorption device then plays a damping role, ensuring that the vibration source is in the sand layer, so as to prevent vibration from upward transmission to the slotted connection part, and thus completing grouting; the first protrusion is staggered with the second protrusion;

the push-pull rod is contained in the holding cavity; a first end of the push-pull rod is connected to the second conversion part, so as to drive the second conversion part up and down within the bar-shaped slot on the slotted connection part; specifically, the push-pull rod can be pushed down within the bar-shaped slot, so as to set to the rigid mode; and can be pulled up within the bar-shaped slot, so as to set to the flexible mode, thereby realizing the rigid-flexible conversion.

Preferably, a third recess is provided on the second conversion part, which matches the second protrusion, and is arranged in correspondence with the second recess. When the push-pull rod is pushed down, the first protrusion is inserted into the first recess while the second protrusion is inserted into the third recess, so that the first conversion portion is engaged with the first connection portion of the flexible shock absorption device, and the second conversion portion is engaged with the second connection portion of the flexible shock absorption device, so as to enhance the fixing effect under the rigid mode.

Preferably, a connection port is provided at a second end of the push-pull rod, to adapt to different grouting equipment for easy connection.

Preferably, the flexible shock absorption device comprises a first connection part, a rubber hose and a second connection part, wherein the first connection part is sealed and connected to the second connection part through the rubber hose; the first connection part is sealed and threaded to the vibration part; and the second connecting section is sealed and threaded to the slotted connection part. The rubber hose absorbs vibration under the flexible mode, ensuring that the vibration source is in the sand layer, so as to prevent vibration from upward transmission to the slotted connection part.

Preferably, the vibratory grouting rod further comprises: an eccentric block and a drive shaft, wherein the drive shaft is contained in the holding cavity along an axial direction of the grouting rod body; a first end of the drive shaft is connected to the vibration part through bearing, and a bottom of the drive shaft is sealed and threaded to the drill bit; a second end of the drive shaft is connected to a driving device; the eccentric block is provided at the first end of the drive shaft. Therein, the drill bit and the drive shaft are sealed and threaded, and the driving device drives the drive shaft to rotate, so as to generate vibration with an eccentric force of the rotating eccentric block. The drive shaft is connected to the vibration part through bearing, which realizes the fixation of the drive shaft.

Preferably, the vibratory grouting rod further comprises: an annular grouting pipe wound on the vibration part, wherein a grouting hose is contained in the holding cavity along an axial direction of the grouting rod body, which communicates with the annular grouting pipe. The annular grouting pipe is arranged for grouting. The grouting hose is contained in the holding cavity for easy storage, which improves the neatness.

Preferably, a water injection pipe is contained in the holding cavity along an axial direction of the grouting rod body, and an injection end of the water injection pipe is in contact with the drill bit. The water injection pipe is contained in the holding cavity and reaches out to drill bit, so that sandy soil in the hole can be flushed away while drilling, which prevents clogging while cooling down, thus improving the drilling efficiency.

The present invention also provides a method for using the vibratory grouting rod, comprising steps of:

S1: assembling the vibratory grouting rod with a grouting equipment, pushing down the rigid-flexible conversion device to set to a rigid mode; determining a designated grouting position, and drilling down;

S2: after drilling to the designated grouting position, ceasing water injection, pulling up the rigid-flexible conversion device to set to a flexible mode, and turning on the grouting equipment to start grouting; and S3: after grouting, turning off the grouting equipment to stop grouting, waiting for a setting time according to a grouting material, and rotating the drill bit while injecting water in order to pull out the grouting rod body.

Compared to the prior art, the technical solution of the present invention presents the following beneficial effects:

I. The vibratory grouting rod comprises a drill bit, a vibration part, a flexible shock absorption device, a slotted connection part, a connection tail part, and a rigid-flexible conversion device; wherein the vibration part, the flexible shock absorption device, the slotted connection part and the connection tail part are sequentially jointed to form a grouting rod body, and the grouting rod body has a holding cavity; the drill bit is provided at a front end of the vibration part; and the rigid-flexible conversion device is movably sleeved on the flexible shock absorption device, which is configured to move up and down in a bar-shaped slot of the slotted connection part to accomplish rigid-flexible conversion. During drilling, the rigid-flexible conversion device pushed down to set to a rigid mode, making the flexible shock absorption device unstressed and protected by the rigid-flexible conversion device, thereby preventing the flexible shock absorption device from being damaged. At this time, the drill bit moves downward to a designated position. During grouting, the rigid-flexible conversion device is pulled up to set to a flexible mode, so that the flexible shock absorption device is exposed. Under the flexible mode, vibration is concentrated in the sandy soil around the vibration part. When the sandy soil is disturbed, the effective stress between soil particles is reduced, which is conducive to the diffusion of slurry, and that is the vibratory grouting. During vibratory grouting, the flexible shock absorption device plays a damping role, to prevent vibration from upward transmission to the slotted connection part and the connection tail part, ensuring that the vibration source is in the sand layer.

II. The rigid-flexible conversion device comprises a first conversion part, a second conversion part and a push-pull rod; wherein a first recess is provided on one side, which is close to the vibration part, of the first conversion part; and a first protrusion is provided on one side, which is close to the vibration part, of the flexible shock absorption device, matching the first recess; when the push-pull rod pushes the second conversion part to a point where the first protrusion is inserted into the first recess, then the rigid mode is set, wherein the first conversion part is engaged with the first connection part of the flexible shock absorption device, so as to drill under the rigid mode; a second recess is provided on the other side, which is close to the slotted connection part, of the first conversion part; and a second protrusion is provided on the other side, which is close to the slotted connection part, of the flexible shock absorption device, matching the second recess; when the push-pull rod pulls the second conversion part to a point where the second protrusion is inserted into the second recess, then the flexible mode is set, wherein the first conversion part is engaged with the second connection part of the flexible shock absorption device; the flexible shock absorption device then plays a damping role, ensuring that the vibration source is in the sand layer, so as to prevent vibration from upward transmission to the slotted connection part, and thus completing grouting; the push-pull rod is contained in the holding cavity; a first end of the push-pull rod is connected to the second conversion part, so as to drive the second conversion part up and down within the bar-shaped slot on the slotted connection part; specifically, the push-pull rod can be pushed down within the bar-shaped slot, so as to set to the rigid mode; and can be pulled up within the bar-shaped slot, so as to set to the flexible mode, thereby realizing the rigid-flexible conversion.

BRIEF DESCRIPTION OF THE DRAWINGS

In order to further illustrate the technical solutions in embodiments of the present invention or prior art, the accompanying drawings will be briefly introduced below. It will be obvious that the accompanying drawings described below are only some of the embodiments of the present invention, and that other drawings can be obtained according to the structures illustrated in the drawings by those of ordinary skill in the art, without creative labor.

ELEMENT REFERENCE

Figure 1:
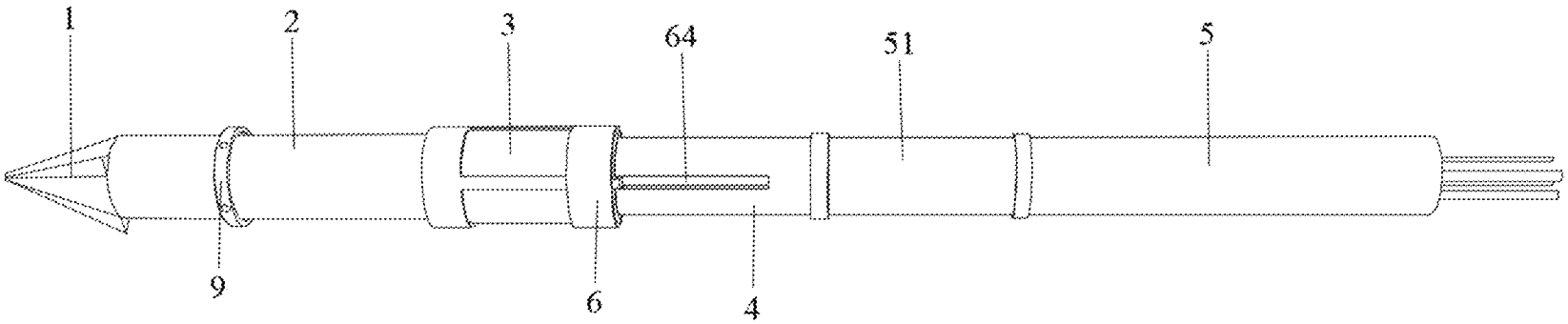
FIG. 1 is a prospective view of a vibratory grouting rod with drilling and vibrating functions according to the present invention.

1—drill bit;

2—vibration part;

3—flexible shock absorption device; 31—first connection part; 311—first protrusion; 32—rubber hose; 33—second connection portion; 331—second protrusion;

4—slotted connection part; 41—bar-shaped slot;

5—connection tail part; 51—stopper plug; 52—delivery pipe;

6—rigid-flexible conversion device; 61—first conversion part; 611—first recess; 612—second recess; 62—fixing post; 63—second conversion part; 631—third recess; 64—push-pull rod; 641—connection port;

7—eccentric block; 8—drive shaft; 9—annular grouting pipe; 10—grouting hose; 11—water injection pipe; 12—grouting rod body; 13—holding cavity.

DETAILED DESCRIPTION OF THE PREFERRED EMBODIMENT

The technical solutions in the embodiments of the present invention will be clearly and completely described below in conjunction with the accompanying drawings. It should be noted that the described embodiments are only a part of all the embodiments of the present invention. Based on the following embodiments, all other embodiments obtained by those of ordinary skill in the art without creative labor shall fall within the protection scope of the present invention.

It should be noted that all directional indications such as first, second, up, down, left, right, front, back . . . in the embodiments of the present invention are only used to explain the relative position, movement, etc., between the components in a particular attitude as shown in the accompanying drawings, and that the directional indications may be changed correspondingly if the particular attitude is changed.

In addition, the technical solutions between the various embodiments of the present invention may be combined with each other, but it must be based on the fact that the person skilled in the art can realize it. When the combination of technical solutions appears to be contradictory or unattainable, it should be considered that the combination of such technical solutions does not exist, and is not within the protection scope claimed by the present invention.

Referring to FIGS. 1-6 of the drawings, a vibratory grouting rod with drilling and vibrating functions is illustrated, comprising: a drill bit 1, a vibration part 2, a flexible shock absorption device 3, a slotted connection part 4, a connection tail part 5, and a rigid-flexible conversion device 6; wherein the vibration part 2, the flexible shock absorption device 3, the slotted connection part 4 and the connection tail part 5 are sequentially jointed to form a grouting rod body 12, and the grouting rod body 12 has a holding cavity 13; specifically, the vibration part 2, the slotted connection part 4, the connection tail part 5 and the flexible shock absorption device 3 together form a complete hollow structure; the drill bit 1 is provided at a front end of the vibration part 2; and the rigid-flexible conversion device 6 is movably sleeved on the flexible shock absorption device 3, which is configured to move up and down in a bar-shaped slot 41 of the slotted connection part 4 to accomplish rigid-flexible conversion. Specifically, the drill bit 1 is provided at the front end of the vibration part 2, and the rear end is docked with the slotted connection part 4 through the flexible shock absorption device 3. The flexible shock absorption device 3 is sealed and threaded to the slotted connection part 4, and the slotted connection section 4 sealed and threaded to the connection tail part 5. During drilling, the rigid-flexible conversion device 6 is pushed down to set to a rigid mode, and a drive shaft 8 drives the drill bit 1 to rotate, making the flexible shock absorption device 3 unstressed and protected by the rigid-flexible conversion device 6, thereby preventing the flexible shock absorption device 3 from being damaged. At this time, the drill bit 1 moves downward to a designated position. During grouting, the rigid-flexible conversion device 6 is pulled up to set to a flexible mode, so that the flexible shock absorption device 3 is exposed, wherein slurry is transported to the vibratory grouting rod by a corresponding grouting machine through a grouting hose 10, and then flows out through an annular grouting pipe 9 connected to the grouting hose 10 at a bottom portion of the vibrating grouting rod. With an air pump, pressure is applied through a delivery pipe 52 to make a stopper plug 51 expand, so as to grout smoothly. Under the flexible mode, vibration is concentrated in the sandy soil around the vibration part 2. When the sandy soil is disturbed, the effective stress between soil particles is reduced, which is conducive to the diffusion of slurry, and that is the vibratory grouting. During vibratory grouting, the flexible shock absorption device 3 plays a damping role, to prevent vibration from upward transmission to the slotted connection part 4 and the connection tail part 5, ensuring that the vibration source is in the sand layer.

Figure 5:
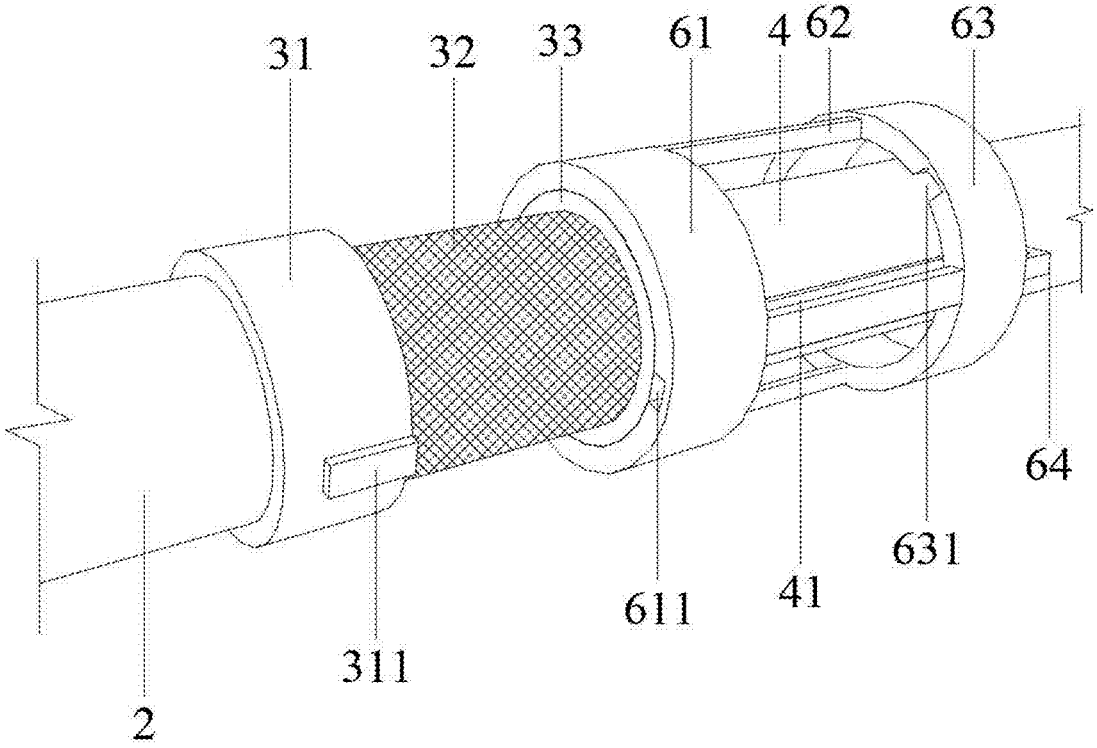
FIG. 5 is a partial view of the vibratory grouting rod according to the present invention.
Figure 6:
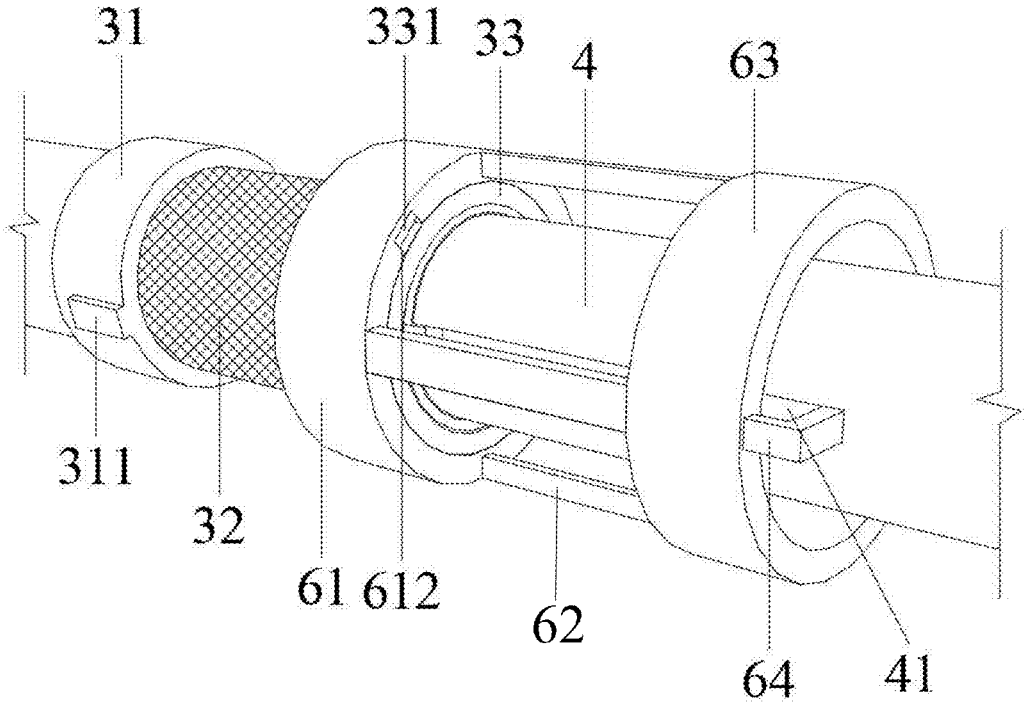
FIG. 6 is a partial view of the vibratory grouting rod according to the present invention from another angle.

Preferably, referring to FIGS. 5 and 6, the rigid-flexible conversion device 6 comprises a first conversion part 61, a second conversion part 63 and a push-pull rod 64; wherein the second conversion part 63 is connected to the first conversion part 61 through a plurality of fixing posts 62;

a first recess 611 is provided on one side, which is close to the vibration part 2, of the first conversion part 61; and a first protrusion 311 is provided on one side, which is close to the vibration part 2, of the flexible shock absorption device 3, matching the first recess 611; when the push-pull rod 64 pushes the second conversion part 63 to a point where the first protrusion 311 is inserted into the first recess 611, then the rigid mode is set, wherein the first conversion part 61 is engaged with the first connection part 31 of the flexible shock absorption device 3, so as to drill under the rigid mode;

a second recess 612 is provided on the other side, which is close to the slotted connection part 4, of the first conversion part 61; and a second protrusion 331 is provided on the other side, which is close to the slotted connection part 4, of the flexible shock absorption device 3, matching the second recess 612; when the push-pull rod 64 pulls the second conversion part 63 to a point where the second protrusion 331 is inserted into the second recess 612, then the flexible mode is set, wherein the first conversion part 61 is engaged with the second connection part 33 of the flexible shock absorption device 3; the flexible shock absorption device 3 then plays a damping role, ensuring that the vibration source is in the sand layer, so as to prevent vibration from upward transmission to the slotted connection part 4, and thus completing grouting; preferably, the first protrusion 311 is staggered with the second protrusion 331;

the push-pull rod 64 is contained in the holding cavity 13; a first end of the push-pull rod 64 is connected to the second conversion part 63, so as to drive the second conversion part 63 up and down within the bar-shaped slot 41 on the slotted connection part 4; specifically, the push-pull rod 64 can be pushed down within the bar-shaped slot 41, so as to set to the rigid mode; and can be pulled up within the bar-shaped slot 41, so as to set to the flexible mode, thereby realizing the rigid-flexible conversion.

Referring to FIG. 5, a third recess 631 is provided on the second conversion part 63, which matches the second protrusion 331, and is arranged in correspondence with the second recess 612. When the push-pull rod 64 is pushed down, the first protrusion 311 is inserted into the first recess 611 while the second protrusion 331 is inserted into the third recess 631, so that the first conversion portion 61 is engaged with the first connection portion 31 of the flexible shock absorption device 3, and the second conversion portion 63 is engaged with the second connection portion 33 of the flexible shock absorption device 3, so as to enhance the fixing effect under the rigid mode.

Figure 4:
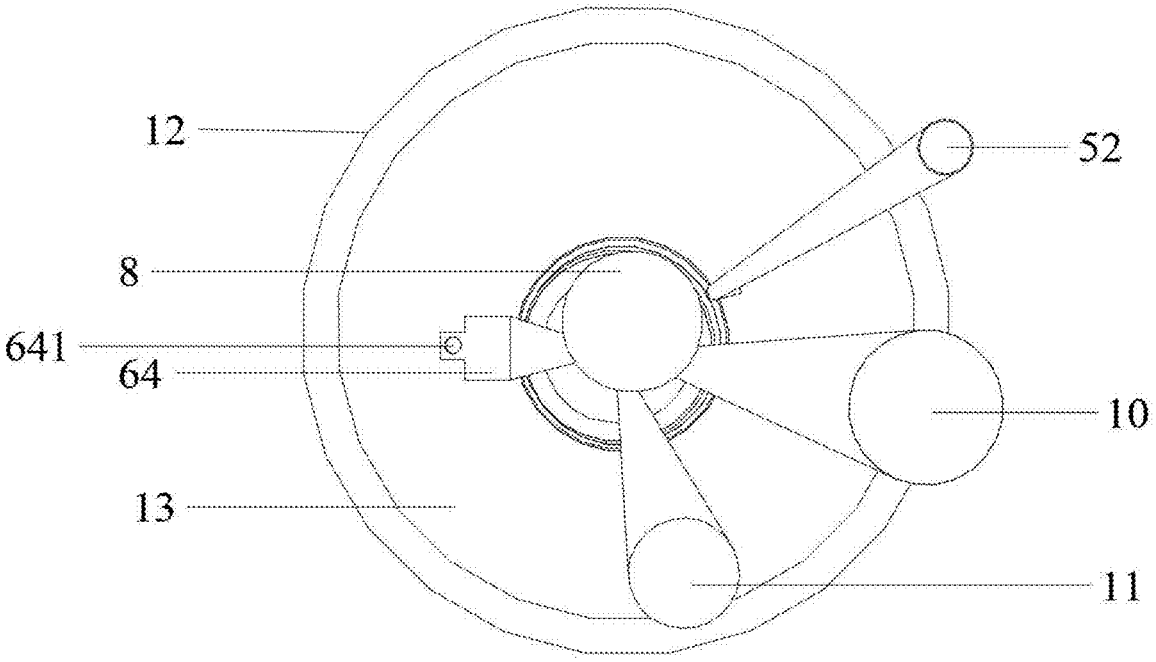
FIG. 4 is a side view of the vibratory grouting rod according to the present invention.

Preferably, referring to FIG. 4, a connection port 641 is provided at a second end of the push-pull rod 64, to adapt to different grouting equipment for easy connection.

Referring to FIGS. 5 and 6, the flexible shock absorption device 3 comprises a first connection part 31, a rubber hose 32 and a second connection part 33, wherein the first connection part 31 is sealed and connected to the second connection part 33 through the rubber hose 32; the first connection part 31 is sealed and threaded to the vibration part 2; and the second connecting section 33 is sealed and threaded to the slotted connection part 4. The first connection part 31 is provided with the first protrusion 311, and the second connection part 33 is provided with the second protrusion 331. Preferably, the first protrusions 311 are symmetrically provided on both sides of the first connection part 31. The first protrusion 311 of the first connection part 31 and the second protrusion 331 of the second connection part 33 can fix the rigid-flexible conversion device 6 under the rigid mode. Under the flexible mode, the rubber hose 32 plays a damping role, ensuring that the vibration source is in the sand layer, so as to prevent the vibration from upward transmission to the slotted connection part 4.

Figure 2:
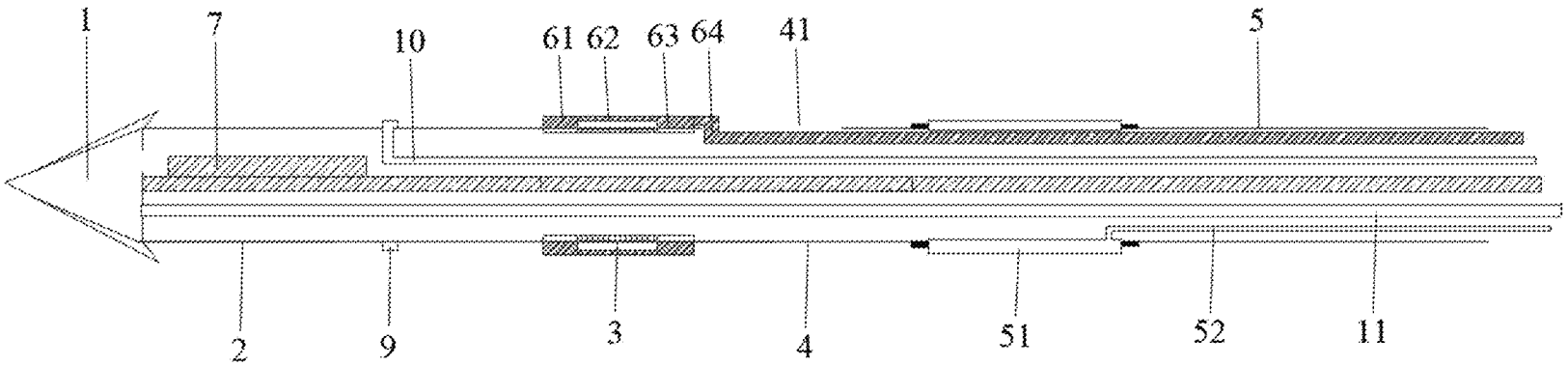
FIG. 2 is a sketch view indicating a rigid mode of the vibratory grouting rod according to the present invention.
Figure 3:
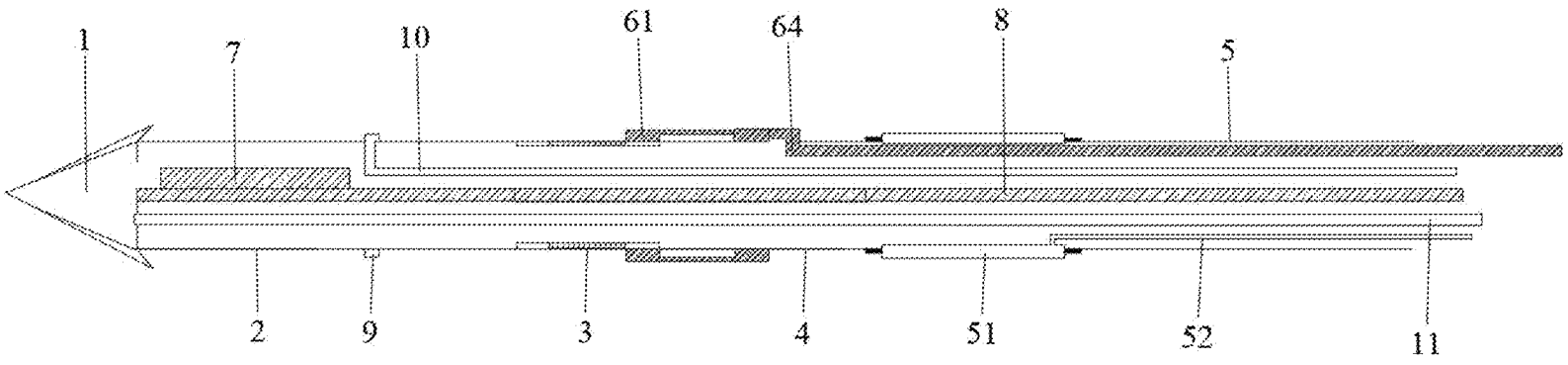
FIG. 3 is a sketch view indicating a flexible mode of the vibratory grouting rod according to the present invention.

Referring to FIGS. 2 and 3, the vibratory grouting rod of the present invention further comprises: an eccentric block 7 and a drive shaft 8, wherein the drive shaft 8 is contained in the holding cavity 13 along an axial direction of the grouting rod body 12, and passes through the holding cavity 13; a first end of the drive shaft 8 is connected to the vibration part 2 through bearing, and a bottom of the drive shaft 8 is sealed and threaded to the drill bit 1; a second end of the drive shaft 8 is connected to a driving device; the eccentric block 7 is provided at the first end of the drive shaft 8, which is powered by the drive shaft 8 to vibrate. Therein, the driving device is a motor, the drill bit 1 and the drive shaft 8 are sealed and threaded, and the driving device drives the drive shaft 8 to rotate, so as to generate vibration with an eccentric force of the rotating eccentric block 7. The drive shaft 8 is connected to the vibration part 2 through bearing, which realizes the fixation of the drive shaft 8.

Referring to FIG. 1, the vibratory grouting rod further comprises: an annular grouting pipe 9 wound on the vibration part 2, wherein a grouting hose 10 is contained in the holding cavity 13 along an axial direction of the grouting rod body 12, which communicates with the annular grouting pipe 9. The annular grouting pipe 9 is arranged outside of the vibration part 2 by means of threads, and communicates with the internal grouting hose 10 via a hose connector. The annular grouting pipe 9 is arranged for grouting. The grouting hose 10 is contained in the holding cavity 13 for easy storage, which improves the neatness.

In addition, a stopper plug 51 is provided on the connection tail part 5, and the connection tail part 5 is docked with the slotted connection part 4 through the stopper plug 51. A delivery pipe 52 is connected to an interior of the stopper plug 51, and is jointed to the stopper plug 51 inside the vibratory grouting rod through a hose connector. The delivery pipe 52 is contained in the holding cavity 13 along an axial direction of the grouting rod body 12, and is connected to an air pump. With the foregoing structure, pressure is applied through the delivery pipe 52 to make the stopper plug 51 expand, so as to grout smoothly and efficiently.

Preferably, a water injection pipe 11 is contained in the holding cavity 13 along an axial direction of the grouting rod body 12, and an injection end of the water injection pipe 11 is in contact with the drill bit 1. The water injection pipe 11 is contained in the holding cavity 13 and reaches out to drill bit 1, so that sandy soil in the hole can be flushed away while drilling, which prevents clogging while cooling down, thus improving the drilling efficiency.

The present invention also provides a method for using the vibratory grouting rod, comprising steps of:

S1: assembling the vibratory grouting rod with a grouting equipment, pushing down the rigid-flexible conversion device 6 to set to a rigid mode; inserting the first protrusion 311 into the first recess 611 and the second protrusion 331 into the third recess 631; determining a designated grouting position, and turning on the motor and the water injection pipe 11 for drilling down;

S2: after drilling to the designated grouting position, turning off the water injection pipe 11 to cease water injection, pulling up the rigid-flexible conversion device 6 to set to a flexible mode; inserting the second protrusion 331 into the second recess 612; turning on the grouting equipment and the air pump and waiting for the stopper plug 51 to start grouting; and S3: after grouting, turning off the grouting equipment to stop grouting, waiting for a setting time according to a grouting material; turning off the air pump and waiting for the stopper plug 51 to recover before pulling out the grouting rod; if the grouting position is deep, turning on the motor to rotate the drill bit 1 while turning on the water injection pipe 11, and then pulling out the grouting rod gently.

According to the present invention, principle of the rigid-flexible conversion device 6 and the flexible shock absorption device 3 is as follows: the push-pull rod 64 can be pushed down within the bar-shaped slot 41, so as to set to the rigid mode; and can be pulled up within the bar-shaped slot 41, so as to set to the flexible mode, thereby realizing the rigid-flexible conversion. Specifically, when the push-pull rod 64 pushes the second conversion part 63 to a point where the first protrusion 311 is inserted into the first recess 611 while the second protrusion 331 is inserted into the third recess 631, so that the first conversion portion 61 is engaged with the first connection portion 31, and the second conversion portion 63 is engaged with the second connection portion 33, then the rigid mode is set for drilling downwards. When the push-pull rod 64 pulls the second conversion part 63 to a point where the second protrusion 331 is inserted into the second recess 612, then the flexible mode is set, wherein the first conversion part 61 is engaged with the second connection part 33; the flexible shock absorption device 3 then plays a damping role, ensuring that the vibration source is in the sand layer, so as to prevent vibration from upward transmission to the slotted connection part 4, and thus completing grouting.

It is to be understood that the above embodiments are described only to illustrate the technical route and features of the present invention, which are intended to enable persons skilled in the art to understand the content of the present invention and implement it accordingly, but not intended to be limiting. Any changes or modifications made within the claimed scope of the present invention shall be covered within the protection scope of the present invention.

What is claimed is:

1. A vibratory grouting rod with drilling and vibrating functions, comprising: a drill bit (1), a vibration part (2), a flexible shock absorption device (3), a slotted connection part (4), a connection tail part (5), and a rigid-flexible conversion device (6); wherein the vibration part (2), the flexible shock absorption device (3), the slotted connection part (4) and the connection tail part (5) are sequentially jointed to form a grouting rod body (12), and the grouting rod body (12) has a holding cavity (13); the drill bit (1) is provided at a front end of the vibration part (2); and the rigid-flexible conversion device (6) is movably sleeved on the flexible shock absorption device (3), which is configured to move up and down in a bar-shaped slot (41) of the slotted connection part (4).

2. The vibratory grouting rod, as recited in claim 1, wherein the rigid-flexible conversion device (6) comprises a first conversion part (61), a second conversion part (63) and a push-pull rod (64); wherein the second conversion part (63) is connected to the first conversion part (61) through a plurality of fixing posts (62);

a first recess (611) is provided on one side of the first conversion part (61); and a first protrusion (311) is provided on one side of the flexible shock absorption device (3), matching the first recess (611);

a second recess (612) is provided on the other side of the first conversion part (61);

a first end of the push-pull rod (64) is connected to the second conversion part (63), so as to drive the second conversion part (63) up and down within the bar-shaped slot (41) on the slotted connection part (4).

3. The vibratory grouting rod, as recited in claim 2, wherein a third recess (631) is provided on the second conversion part (63), and is arranged in correspondence with the second recess (612).

4. The vibratory grouting rod, as recited in claim 2, wherein a connection port (641) is provided at a second end of the push-pull rod (64).

5. The vibratory grouting rod, as recited in claim 1, wherein the flexible shock absorption device (3) comprises a first connection part (31), a rubber hose (32) and a second connection part (33), wherein the first connection part (31) is sealed and connected to the second connection part (33) through the rubber hose (32); the first connection part (31) is sealed and threaded to the vibration part (2); and the second connecting section (33) is sealed and threaded to the slotted connection part (4).

6. The vibratory grouting rod, as recited in claim 1, further comprising: an eccentric block (7) and a drive shaft (8), wherein the drive shaft (8) is contained in the holding cavity (13) along an axial direction of the grouting rod body (12); a first end of the drive shaft (8) is connected to the vibration part (2) through a bearing, a second end of the drive shaft (8) is connected to a driving device; the eccentric block (7) is provided at the first end of the drive shaft (8).

7. The vibratory grouting rod, as recited in claim 1, wherein a water injection pipe (11) is contained in the holding cavity (13) along an axial direction of the grouting rod body (12), and an injection end of the water injection pipe (11) is in contact with the drill bit (1).

8. A method for using the vibratory grouting rod as recited in claim 1, comprising steps of:

S1: assembling the vibratory grouting rod with a grouting equipment, pushing down the rigid-flexible conversion device (6) to set to a rigid mode; determining a designated grouting position, and drilling down;

S2: after drilling to the designated grouting position, pulling up the rigid-flexible conversion device (6) to set to a flexible mode; and S3: waiting for a setting time according to a grouting material, and rotating the drill bit (1) while injecting water in order to pull out the grouting rod body (12).

* * * * *